United States Patent [19]

Nakatsu

[11] 4,244,301

[45] Jan. 13, 1981

[54] CORNER SHELF ARRAY

[76] Inventor: Daniel T. Nakatsu, 117 Westwood Dr., San Francisco, Calif. 94112

[21] Appl. No.: 36,649

[22] Filed: May 7, 1979

Related U.S. Application Data

[63] Continuation-in-part of Ser. No. 917,107, Jun. 19, 1978, Pat. No. 4,187,787.

[51] Int. Cl.[3] ..... A47B 5/00

[52] U.S. Cl. ..... 108/149; 108/96; 211/113; 248/328; 312/4; 312/5

[58] Field of Search ..... 108/96, 101, 106, 107, 108/149; 211/113, 117, 118; 248/323, 327, 328; 312/3, 4, 5, 6

[56] References Cited

U.S. PATENT DOCUMENTS

| | | | |
|---|---|---|---|
| 753,721 | 3/1904 | Magui et al. | 312/4 |
| 1,013,729 | 1/1912 | Bell | 312/5 |
| 1,121,211 | 12/1914 | Vaughn | 312/5 |
| 2,556,105 | 6/1951 | Rhett | 108/106 |
| 3,025,970 | 3/1962 | Ostrum | 108/96 |
| 3,382,819 | 5/1968 | Deutsch | 108/149 X |
| 3,901,165 | 8/1975 | Schlesinger | 211/113 X |
| 3,906,872 | 9/1975 | Erickson | 108/101 X |
| 4,129,080 | 12/1978 | Vall | 108/149 |

FOREIGN PATENT DOCUMENTS

| | | | |
|---|---|---|---|
| 37586 | 2/1909 | Austria | 211/113 |
| 608482 | 7/1926 | France | 108/149 |
| 187074 | 10/1922 | United Kingdom | 312/4 |
| 324570 | 1/1930 | United Kingdom | 312/4 |

*Primary Examiner*—James T. McCall

*Attorney, Agent, or Firm*—Laurence R. Brown

[57] ABSTRACT

A pre-assembled array of corner shelves is fastened together by three flexible lines threaded through apertures in the shelves so that they can hang downwardly from a single hook mounted in the corner between two intersecting walls. The lines are so disposed to form an acute angle with the corner line toward the frontmost edge of the shelf disposed in the corner, thereby to force the shelf against the corner and adjacent walls by its own weight and that of objects on it to support the structure and prevent it from slipping or sliding. The spacing may be rearranged simply by moving the lines and the shelves may be readily leveled in the same manner. The shelf array is simply removed for cleaning walls or the shelves without loosening any mounting hardware.

4 Claims, 6 Drawing Figures

CORNER SHELF ARRAY

TECHNICAL FIELD

This application is a continuation-in-part application of U.S. Ser. No. 917,107 filed June 19, 1978, now U.S. Pat. No. 4,187,787, and relates to a triangular corner hanging embodiment of the shelf array of that previous application.

This invention relates to shelving and more particularly it relates to shelving having an array of shelves suspended solely by a flexible line from a hook assembly to hang adjacent a wall.

BACKGROUND ART

Prior to the present invention including its predecessor embodiment above-identified, there has been known only one shelving array that can be suspended solely from a hook assembly to hang against a wall, namely that shown in H. S. Rhett, U.S. Pat. No. 2,556,105, June 5, 1951. However, that array could not easily be levelled, nor could the shelf position against the wall be changed easily because of a link chain assembly fastened to each shelf by a confining hardware accessory. Also these shelves preferably required fastening the individual shelves to the wall.

Other hanging shelf arrays disposing the shelves against the wall also required for stability some kind of hardware holding the shelves against the wall and could not simply be positioned by its own performance securely against the wall, and yet removable intact for relocation, wall cleaning, etc. by simply unhooking from a top mounting hook. These other shelving arrays are exemplified by J. K. Slaboden, U.S. Pat. No. 3,799,072, Mar. 26, 1974 and E. Ostrom, U.S. Pat. No. 3,025,970, Mar. 20, 1962.

Accordingly, it is a general object of this invention to provide improved shelving array that can be mounted in a corner intersection of two walls and be self-supporting from a single mounting hook to stably rest against the walls adjacent the corner without other mounting means.

DISCLOSURE OF THE INVENTION

In accordance with this invention, there is provided an array of triangular shelves suspended to hang from a single hook in a corner between two intersecting walls by means of a set of three flexible lines threaded through apertures in the shelves. The lines are so disposed to make the weight of the shelves and their contents force the shelves into contact with the wall in supporting relationship so that the sole support is an uppermost hook disposed above the shelves in a corner. Thus, the shelves may be easily removed intact for relocation, wall cleaning, etc. Furthermore, the flexible lines are looped through the shelf apertures so that the shelves are easily adjusted for leveling or changing position between the shelves or against the wall. They may also be preassembled in a unit and shipped knocked down so that they attain a predetermined preadjusted optimum shelf spacing and need only be taken by a ring or the like fitting for disposal on a hook for hanging in place on the wall without further supports.

BRIEF DESCRIPTION OF THE DRAWINGS

In the accompanying drawings the construction of a preferred embodiment is shown. Further features and advantages of the invention will be understood when considering the detailed description with reference to the drawing, wherein.

DETAILED DESCRIPTION OF THE PREFERRED EMBODIMENT

Figure 1:
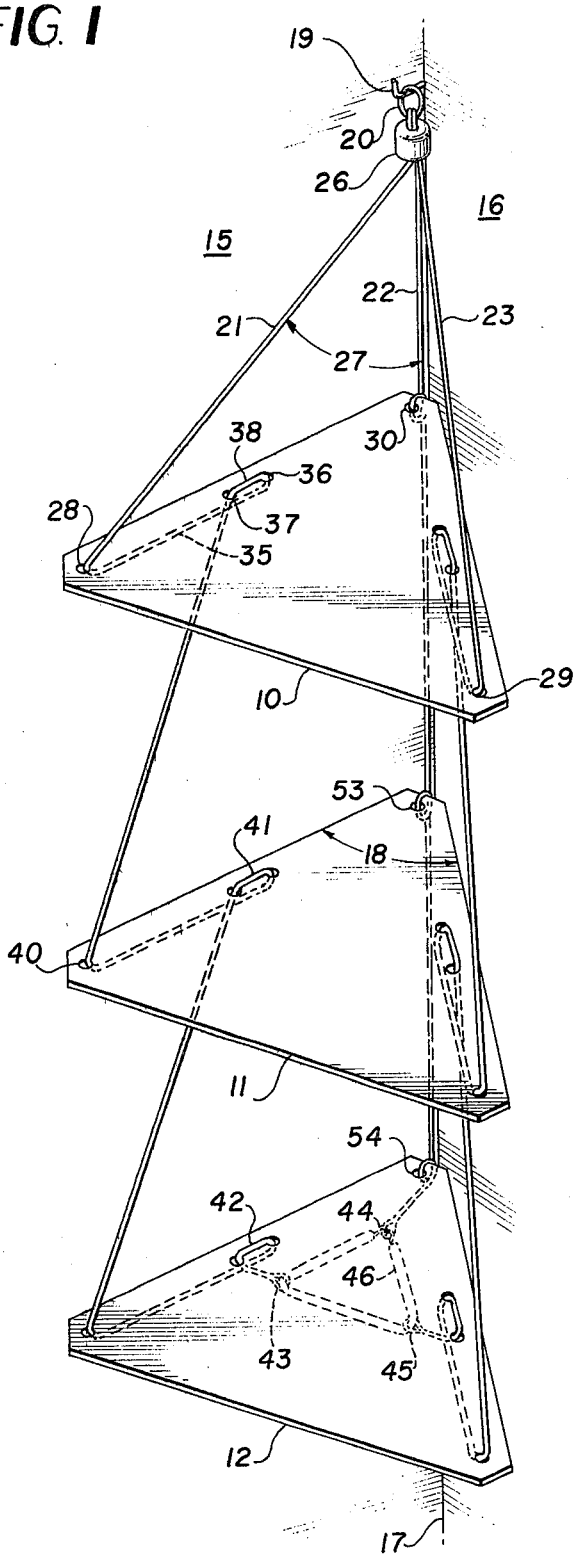
FIG. 1 is a perspective view of a cabinet array embodiment provided by this invention mounted in a corner at the intersection of two walls.
Figure 2:
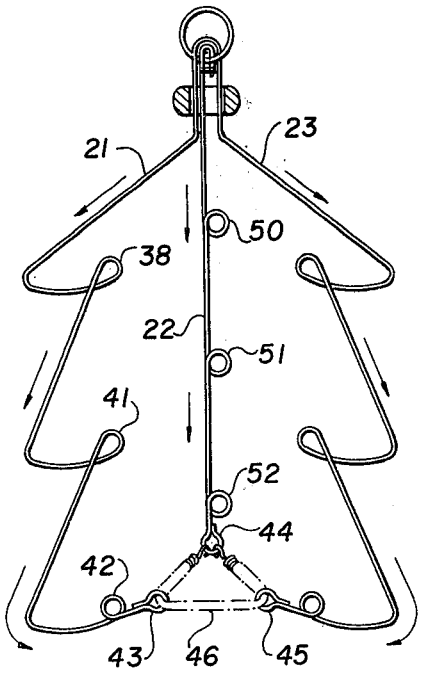
FIG. 2 is a sketch showing the threading pattern of three flexible lines as threaded through the apertures in each of the corner shelves.
Figure 3:
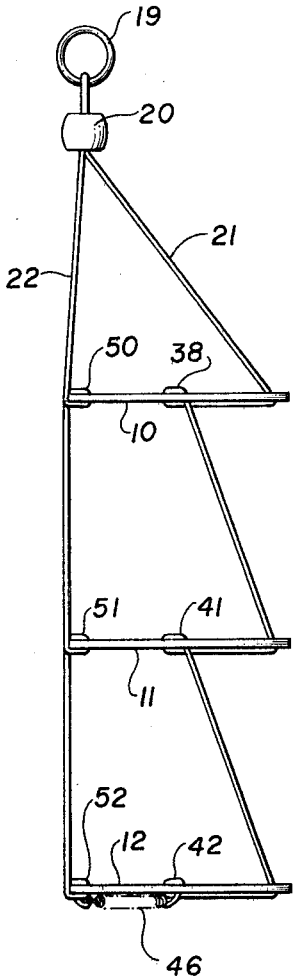
FIGS. 3 to 5 are respectively a side view, a front view and a top view of an assembled set of shelves.
Figure 4:
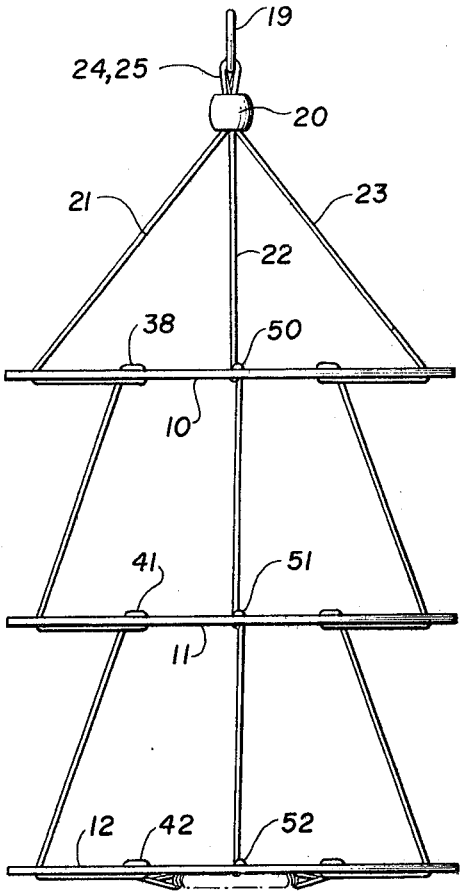
Figure 5:
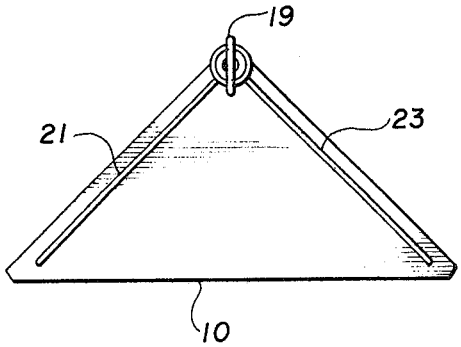

The manner of assembly of the shelf array and the structural details are seen from the views of FIGS. 1 and 2 and the profiles of a hanging shelf array is shown in FIGS. 3 to 5. Like reference characters are used in the various views for purpose of comparison.

The shelf array shown has three shelves 10, 11 and 12, but also may be made of one, two, or more than three using the same techniques. Each shelf is generally triangular and arranged to seat in the angle formed by two intersecting walls 15, 16 forming the corner line 17. This is normally 90° so that the angle 18 substended by the shelves is 90°.

Figure 1A:
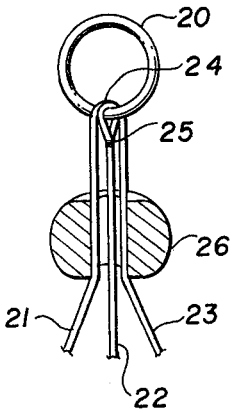
FIG. 1A is an enlarged view of the hanging assembly shown in FIG. 1, partly in section.

The shelves are mounted on a single hook 19 disposed in the corner by means of a ring assembly 20 to which three flexible lines 21, 22, 23 are attached in the manner more clearly shown in FIG. 1A. Thus one loop 24 is made of a continuous flexible filament such as 6.4 mm ($\frac{1}{4}$ inch) diameter poly rope of breakstrength 273 Kgs (600 pounds), thereby to form lines 21 and 23. A second flexible filament 22 is terminated in the loop 25 which is secured by a wire clamp or the like.

The strain relieving ring collar 26 positions the separate exiting lines 21 and 23 to diverge making an acute angle 27 with the corner and passing through a first aperture in the shelf near the opposite outermost corners of the shelf adjacent the respective walls as designated at 28, 29. This angular relationship of flexible lines 21, 23 with the weight of the shelf 10, and any objects thereon, causes a force on the shelf 10 toward the wall tending to wedge the shelf in the corner in supporting position against the walls 15, 16. The rearmost corner aperture 30 receives the third line 22 in a disposition substantially parallel to the corner line 17.

As seen by phantom lines under the shelves, the lines are threaded in the manner as generally depicted in FIG. 2 with loops about the shelves to anchor them in spaced relationship. Thus, the frontmost lines 21, 23 pass through aperture 28 and under the shelf at 35 coming up through aperture 36 and back down through aperture 37 disposing segment 38 above the shelf.

Thus, the lines 21, 23 are fed from a topmost shelf 10 to a lower shelf 11 at an acute angle (similar to 27) from aperture 38 frontwards toward aperture 40 of shelf 11 to provide the seating force pushing shelf 11 back toward the corner and into contact with walls 15, 16 by its own weight. It is seen that the same pattern is used throughout the shelving forming the loops 38, 41, 42, etc. shown in FIG. 2 before arriving at an endmost loop 43 at the bottom of the lowermost shelf 12. There, the three end loops 43, 44, 45 are resiliently held in place by a single spring 46 which gives enough flexible tensioning to tend to let the bottom shelf self level and also to take up slackage predisposed at the rope ends for permitting downward adjustment of the bottom shelf height. The rearmost line 22 is also looped 50, 51, 52 about apertures 30, 53, 54 in the respective shelves 10, 11, 12. Thus the profiles of the assembled shelves are as seen in the FIGS. 3, 4 and 5 side, front and top views respectively.

It is therefore seen that the shelf array provided by this invention is stably seated in a corner disposed at the intersection between two walls as suspended by ring 19 from a single hook as the sole mounting means. Thus, the shelf array may be readily removed for cleaning walls and shelves, yet is stably supported against the walls so it cannot swing or sway and so that the supporting friction against the walls becomes greater as the loading on the shelves increases. Furthermore, the shelf array can be completely pre-assembled with the shelves secured at optimum spacing so that it is packaged in a carton slightly deeper than the three shelves 10, 11 and 12 in compact form and need not be assembled upon unpacking but can be immediately hung in the manner shown in FIG. 1. Having therefore provided novel and useful shelving arrays those features of novelty believed descriptive of the spirit and nature of the invention are defined with particularity in the claims presented herewith.

INDUSTRIAL APPLICATION

An array of shelving for mounting in a corner can be shipped conveniently in pre-assembled but knocked-down form because of interconnecting flexible lines passed through the shelves to hold them in proper spacing and in position for self support against the wall. Thus, a package slightly larger than a stack of the shelves themselves will hold an array of shelving that can be unpacked and hanged from a single corner hook without any assembly or rearrangement, unless desired to change shelf spacing. No other mounting devices are necessary because of the self supporting structure which causes the shelves by their weight and that of objects thereon to attain a self supporting position wedged against the walls adjacent the corner.

I claim:

1. A shelf array suspendable from a single hook for disposal in a corner location adjacent two intersecting walls, comprising in combination, at least one shelf generally triangular in shape having defined therein near an edge along two sides and in triangular corner therebetween a series of apertures, a flexible line array comprising three flexible lines arrayed in three parts respectively through the apertures in the corner and the apertures along the two adjacent edges respectively with loops through the shelf in all three lines to thereby support it in a changeable position that is movable to level the shelf or to adjust spacing of the shelf against the wall, holding means comprising a ring member surrounding all three lines adjacent the corner location and a securing member adjacent thereto securing an uppermost one end of one of the three lines to retain the line through the corner aperture substantially parallel to the intersection of the walls when hanging and to dispose the other two lines toward an uppermost shelf at an acute angle away from the corner respectively to the foremost aperture along the two edges thereby to cause the weight of the shelf and any contents thereon to be urged toward the corner for contact with the walls adjacent thereto for support and stability.

2. A shelf array as defined in claim 1 wherein a plurality of shelves are disposed in parallel spaced relationship by said flexible line array.

3. An array as defined in claim 2 wherein the apertures along the edges includes a foremost aperture near a corner and a further aperture spaced between two corners and the lines are fed from a topmost shelf to a lower shelf at an acute angle defined by the passage of the line from the further aperture of the upper shelf to the foremost aperture of a lower shelf thereby providing a force from weight of the lower shelf and any contents thereon urging that shelf into supporting contact with the walls adjacent the corner.

4. A shelf array as defined in claim 2 wherein the flexible lines are passed through a lowermost shelf and biasing means below the lowermost shelf flexibly engaging the ends of the three lines with a common spring array to take up slack and permit relative longitudinal movement of any individual line.

* * * * *